US008388419B2

(12) United States Patent
Koenig, Jr.

(10) Patent No.: US 8,388,419 B2
(45) **Date of Patent: *Mar. 5, 2013**

(54) SANDING BLOCK

(75) Inventor: Joseph M. Koenig, Jr., Glenview, IL (US)

(73) Assignee: Trim-Tex, Inc., Lincolnwood, IL (US)

( * ) Notice: Subject to any disclaimer, the term of this patent is extended or adjusted under 35 U.S.C. 154(b) by 1885 days.

This patent is subject to a terminal disclaimer.

(21) Appl. No.: 10/692,703

(22) Filed: Oct. 24, 2003

(65) Prior Publication Data

US 2004/0092219 A1 May 13, 2004

Related U.S. Application Data

(63) Continuation of application No. 10/158,608, filed on May 30, 2002, now abandoned.

(51) Int. Cl.
*B24D 11/00* (2006.01)

(52) U.S. Cl. ..... 451/526; 451/461

(58) Field of Classification Search ..... 451/461, 451/523, 526

See application file for complete search history.

(56) References Cited

U.S. PATENT DOCUMENTS

| | | | | | |
|---|---|---|---|---|---|
| 1,455,559 | A | | 5/1923 | Wright et al. | |
| 2,386,900 | A | * | 10/1945 | Kingman | 451/540 |
| 2,414,036 | A | | 1/1947 | Gerhan | |
| D152,607 | S | | 2/1949 | Gerlinger | |
| 2,531,588 | A | * | 11/1950 | Stucker | 451/512 |
| 2,553,254 | A | * | 5/1951 | Hays | 451/520 |
| 2,765,593 | A | | 10/1956 | Salmon et al. | |
| 2,773,338 | A | | 12/1956 | Carter | |
| 3,089,294 | A | | 5/1963 | Cowley | |
| 3,267,052 | A | * | 8/1966 | Brennan | 523/164 |
| 3,627,866 | A | * | 12/1971 | Laws | 264/148 |
| 4,242,843 | A | | 1/1981 | Phillips | |
| 4,478,011 | A | | 10/1984 | Russell | |
| 4,887,396 | A | * | 12/1989 | Lukianoff | 451/523 |
| D319,766 | S | | 9/1991 | Erickson | |
| 5,054,248 | A | | 10/1991 | Thayer | |
| D329,583 | S | | 9/1992 | Medina | |
| 5,429,545 | A | * | 7/1995 | Meyer | 451/523 |
| D365,507 | S | | 12/1995 | Pope | |
| D377,305 | S | | 1/1997 | Bliss | |

(Continued)

OTHER PUBLICATIONS

Drawing, Figures 1 through 8, of prior sanding block sold bt Trim-Tex, Inc. of Lincolnwood, Illinois, which sanding block is admitted prior art.

*Primary Examiner* — Maurina Rachuba

(74) *Attorney, Agent, or Firm* — Wood, Phillips, Katz, Clark & Mortimer

(57) ABSTRACT

In a sanding block having two expansive sides and two adjacent sides, each adjacent side adjoins each expansive side at a given one of two opposite edges of that expansive side. The expansive and adjacent sides are abrasive. When viewed macroscopically before the sanding block becomes worn, the expansive sides between their opposite edges are planar and are parallel, a given one of the opposite edges of each expansive side is a curved edge, which defines a radius not less than about ⅛ inch at any location on the curved edge, and the other one of the opposite edges of each expansive side is a sharp edge, which defines an acute angle in a range from about 55° to about 70°. The curved edges are intended to minimize gouging or scuffing due to uneven pressure being applied by a user holding the sanding block in one hand and to minimize damage when gouging or scuffing due thereto occurs. The sanding block is intended particularly for drywall-finishing uses but is expected to be also useful for fiberglass-finishing, metal-finishing, wood-finishing, and other uses.

10 Claims, 1 Drawing Sheet

U.S. PATENT DOCUMENTS

| | | | | |
|---|---|---|---|---|
| D392,868 | S | 3/1998 | Ansalvish | |
| D429,136 | S | 8/2000 | Ali et al. | |
| 6,227,959 | B1 | 5/2001 | Beaudry | |
| 6,267,658 | B1 | 7/2001 | Ali et al. | |
| 6,524,175 | B2 * | 2/2003 | Beaudry et al. | 451/524 |
| D480,619 | S * | 10/2003 | Koenig, Jr. | D8/90 |
| 6,896,606 | B1 * | 5/2005 | Turgeon et al. | 451/524 |
| 2001/0000503 | A1 * | 4/2001 | Beaudry et al. | 451/523 |
| 2002/0173258 | A1 * | 11/2002 | Biddle et al. | 451/490 |

* cited by examiner

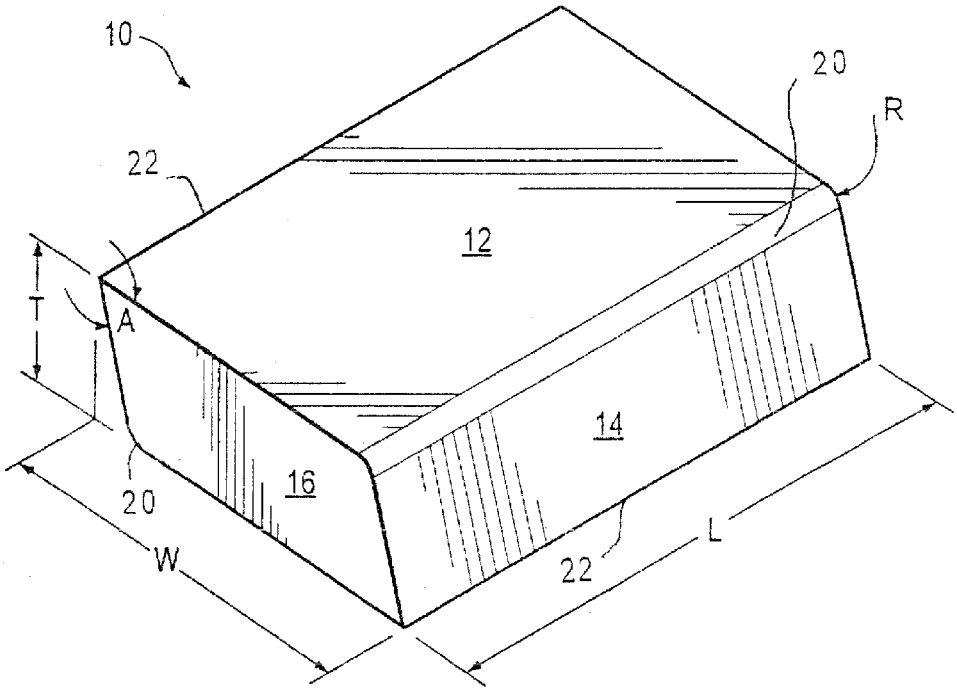
10
20
R
22
12
T
A
14
16
20
W
22
L

SANDING BLOCK

CROSS-REFERENCE TO RELATED APPLICATION

This application is a continuation of U.S. patent application Ser. No. 10/158,608, which was filed on May 30, 2002 now abandoned.

TECHNICAL FIELD OF THE INVENTION

This invention pertains to a sanding block intended particularly for drywall-finishing uses but expected to be also useful for fiberglass-finishing uses, metal-finishing uses, wood-finishing uses, and other similar and dissimilar uses.

BACKGROUND OF THE INVENTION

Sanding blocks, which include sanding pads and sanding sponges, of various types are known. Sanding blocks of a first known type are monolithic blocks of pumice or other inherently abrasive materials, which may be porous or nonporous, which may be flexible or inflexible in normal uses, and which may be compressible or incompressible in normal uses. Sanding blocks of a second known type have cores of suitable materials, which may be flexible or inflexible in normal uses and which may be compressible or incompressible in normal uses, with abrasive materials, such as abrasive grit, emery sheets, or sandpaper sheets, which are bonded to the cores. Except as illustrated in the drawings and described herein, particulars of the cores and abrasive materials and of bonding of abrasive materials to the cores are known and are outside the scope of this invention.

As sold by Trim-Tex, Inc. of Lincolnwood, Ill., and admitted here to constitute prior art, a sanding block of the second known type has abrasive grit bonded to a core, which is made of a flexible, compressible, polymeric foam. The sanding block is a six-sided block having two expansive sides, to each of which abrasive grit is bonded, two adjacent sides, to each of which abrasive grit is bonded, and two lateral sides, which do not have abrasive grit and at which the core is exposed. Each adjacent side meets each expansive side at two opposite edges. The sanding block has comparatively coarser, abrasive grit bonded to a given one of the expansive sides and to a given one of the adjacent sides and comparatively finer, abrasive grit bonded to the other one of the expansive sides and to the other one of the adjacent sides.

When viewed macroscopically before the sanding block becomes worn, the sanding block is tapered at its adjacent sides so that a given one of the opposite edges defines an obtuse angle and so that the other one of the opposite edges defines an acute angle in a range from about 55° to about 70°. The acute angle enables a user holding the sanding block in one hand to sand a surface with said expansive side, as far as another surface intersecting the surface being sanded at a right angle, without scuffing the intersecting surface with the adjacent side meeting said expansive side at the acute angle. However, if the user holding the sanding block in one hand applies uneven pressure, gouging of the surface being sanded can occur easily at the opposite edge, which defines the obtuse angle.

SUMMARY OF THE INVENTION

This invention provides a sanding block conforming, when viewed macroscopically before the sanding block becomes worn, substantially to a block having two expansive sides and two adjacent sides. A given one of the expansive sides is abrasive. The given one of the expansive sides has two opposite edges, at each of which one of the adjacent sides adjoins the given one of the expansive sides. A given one of the opposite edges, when viewed macroscopically before the sanding block becomes worn, is a sharp edge. The other one of the opposite edges, when viewed macroscopically before the sanding block becomes worn, is a curved edge.

Preferably, when viewed macroscopically before the sanding block becomes worn, the sharp edge defines an acute angle in a range from about 55° to about 70°. Preferably, when viewed macroscopically before the sanding block becomes worn, the curved edge defines a radius not less than about ⅛ inch at any location on the curved edge. Preferably, the other one of the expansive sides and the other one of the adjacent sides also are abrasive.

Herein, a given side of a sanding block is regarded as abrasive if the sanding block is inherently abrasive at the given side or if the sanding block has abrasive grit, an emery sheet, a sandpaper sheet, or other abrasive material bonded to the given side.

BRIEF DESCRIPTION OF THE DRAWING

The single FIGURE is an isometric view of a sanding block constituting a preferred embodiment of this invention.

DETAILED DESCRIPTION OF THE ILLUSTRATED EMBODIMENT

As illustrated in the drawing, a sanding block 10 constituting a preferred embodiment is of the second type described above as having abrasive grit bonded to a core, which is made of a flexible, compressible, polymeric foam. Before the sanding block 10 becomes worn, it conforms substantially to a parallelepided having two expansive, rectangular sides 12, to which abrasive grit is bonded, two adjacent, rectangular sides 14, to which abrasive grit is bonded, and two lateral, trapezoidal sides 16, which do not have abrasive grit and at which the core is exposed. As indicated in the drawing, exemplary dimensions enabling a user to hold the sanding block 10 comfortably in one hand are a length (L) about 5 inches, a width (W) of about 3¼ inches, and a thickness (T) of about 1 inch.

Each adjacent side 14 meets each expansive side 12 at two opposite edges. When viewed macroscopically before the sanding block becomes worn, the sanding block is tapered at its adjacent sides 14, as illustrated in the drawing. According to this invention, a given one of the opposite edges of each expansive side 12 is a curved edge 20 and the other one of the opposite edges is a sharp edge 22 defining an acute angle (A) in a range from about 55° to about 70°, an acute angle of about 70° being illustrated.

Preferably, the sanding block 10 has comparatively coarser, abrasive grit bonded to a given one of the expansive sides 12, to whichever of the adjacent sides 14 adjoins the given one of the expansive sides 12 at one of the curved edges 20, and to the curved edges 20 where they adjoin and the sanding block 10 has comparatively finer, abrasive grit bonded to the other one of the expansive sides 12, to whichever of the adjacent sides 14 meets the other one of the expansive sides 12 at one of the curved edges 20, and to the curved edges 20 where they adjoin. Alternatively, the sanding block 10 has similar grit bonded to each expansive side 12, to each adjacent side 14, and to each curved edge 20.

As indicated in the drawing, when viewed macroscopically before the sanding block 10 becomes worn, each curved edge

20 defines a radius (R) which equals about ⅛ inch at any location on the curved edge 20. Each curved edge 20 is intended to minimize gouging or scuffing due to uneven pressure being applied by a user holding the sanding block 10 in one hand, for sanding with either of the expansive sides 12 or with either of the adjacent sides 14, and to minimize damage when gouging or scuffing due thereto occurs.

Although the sanding block 10 is intended particularly for drywall-finishing uses, the sanding block 10 is expected to be also useful for fiberglass-finishing, metal-finishing, wood-finishing, and other uses.

The invention claimed is:

1. A sanding block comprising an abrasive grit bonded to a flexible, compressible, polymeric foam core, the sanding block conforming, when viewed macroscopically before the sanding block becomes worn, substantially to a block having two expansive sides and two adjacent sides, wherein both of the expansive sides are abrasive, wherein each of the expansive sides has two opposite edges, at each of which one of the adjacent sides adjoins the expansive side, wherein for each expansive side a given one of the opposite edges, when viewed macroscopically before the sanding block becomes worn, is a sharp edge, and wherein the other one of the opposite edges, when viewed macroscopically before the sanding block becomes worn, is a curved edge.

2. The sanding block of claim 1 wherein, when viewed macroscopically before the sanding block becomes worn, each curved edge defines a radius not less than about ⅛ inch at any location on said curved edge, the radius of one curved edge being substantially equal to the radius of the other curved edge.

3. The sanding block of claim 1 wherein, when viewed macroscopically before the sanding block becomes worn, each sharp edge defines an acute angle in a range from about 55° to about 70°.

4. The sanding block of claim 2 wherein, when viewed macroscopically before the sanding block becomes worn, each sharp edge defines an acute angle in a range from about 55° to about 70°.

5. The sanding block of claim 1 wherein the adjacent side adjoining the given one of the expansive sides at the sharp edge also is abrasive.

6. The sanding block of claim 2 wherein the adjacent side adjoining the given one of the expansive sides at the sharp edge also is abrasive.

7. The sanding block of claim 3 wherein the adjacent side adjoining the given one of the expansive sides at the sharp edge also is abrasive.

8. The sanding block of claim 4 wherein the adjacent side adjoining the given one of the expansive sides at the sharp edge also is abrasive.

9. The sanding block of claim 5 wherein the other one of the expansive sides and the other one of the adjacent sides also are abrasive.

10. A sanding block comprising an abrasive grit bonded to a flexible, compressible, polymeric foam core, the sanding block conforming, when viewed macroscopically before the sanding block becomes worn, substantially to a block having two expansive sides and two adjacent sides, wherein both of the expansive sides are abrasive, wherein each of the expansive sides has two opposite edges, at each of which one of the adjacent sides adjoins the expansive side, wherein for each expansive side a given one of the opposite edges, when viewed macroscopically before the sanding block becomes worn, is a sharp edge, and wherein the other one of the opposite edges, when viewed macroscopically before the sanding block becomes worn, is a curved edge and wherein, when viewed macroscopically before the sanding block becomes worn, the radius of one curved edge being substantially equal to the radius of the other curved edge.

* * * * *